US005172671A

United States Patent [19]

Peters et al.

[11] Patent Number: 5,172,671

[45] Date of Patent: Dec. 22, 1992

[54] FUEL DISTRIBUTOR FOR FUEL INJECTION SYSTEMS OF INTERNAL COMBUSTION ENGINES

[75] Inventors: Klaus-Jürgen Peters, Affalterbach-Birkhau; Heinz Ehrentraut, Stuttgart; Helmut Bassler, Weinstadt, all of Fed. Rep. of Germany

[73] Assignee: Robert Bosch GmbH, Stuttgart, Fed. Rep. of Germany

[21] Appl. No.: 781,160

[22] PCT Filed: Apr. 5, 1990

[86] PCT No.: PCT/DE90/00267

§ 371 Date: Nov. 8, 1991

§ 102(e) Date: Nov. 8, 1991

[87] PCT Pub. No.: WO90/13740

PCT Pub. Date: Nov. 15, 1990

[30] Foreign Application Priority Data

May 9, 1989 [DE] Fed. Rep. of Germany ..... 3915111

[51] Int. Cl.[5] ..... F02M 55/00

[52] U.S. Cl. ..... 123/470; 123/468; 123/456

[58] Field of Search ..... 123/509, 456, 468, 469, 123/470, 472

[56] References Cited

U.S. PATENT DOCUMENTS

| | | | |
|---|---|---|---|
| 4,327,690 | 5/1982 | Sauer et al. | 123/468 |
| 4,519,371 | 5/1985 | Nagase et al. | 123/470 |
| 4,751,905 | 6/1988 | Bonfiglioli et al. | 123/470 |
| 4,768,487 | 9/1988 | Yamamoto et al. | 123/470 |
| 4,799,470 | 1/1989 | Honda et al. | 123/470 |
| 4,844,036 | 7/1989 | Bassler et al. | 123/468 |
| 4,996,961 | 3/1991 | Usui | 123/456 |
| 5,044,338 | 9/1991 | Shelton | 123/456 |
| 5,072,710 | 12/1991 | Washizu | 123/456 |
| 5,090,385 | 2/1992 | Usui et al. | 123/456 |
| 5,094,211 | 3/1992 | Mahnke et al. | 123/456 |

*Primary Examiner*—Carl S. Miller
*Assistant Examiner*—Thomas N. Moulis
*Attorney, Agent, or Firm*—Edwin E. Greigg; Ronald E. Greigg

[57] ABSTRACT

A fuel distributor for fuel injection systems of internal combustion engines has a distributor housing having a plurality of location holes, connected to each other by a fuel supply line, for accommodating electromagnetically actuated fuel injection valves, a hold-down firmly clamped on the distributor housing, for fixing the fuel injection valves in the location holes, and fixing means for fixing the distributor housing to the intake manifold of the internal combustion engine. For the noise decoupling of the fuel distributor from the adjacent add-on pieces, a noise-decoupling flat gasket is placed between the distributor housing and the hold-down on the one hand and the fixing means are formed by rubber-metal elements on the other hand. If the fuel distributor is made of plastic, the rubber-metal elements are preferably made of a clamping bolt, a metallic distance sleeve and a resilient sleeve, which are arranged coaxially in the sequence mentioned and pass through through holes in the distributor housing and hold-down.

21 Claims, 1 Drawing Sheet

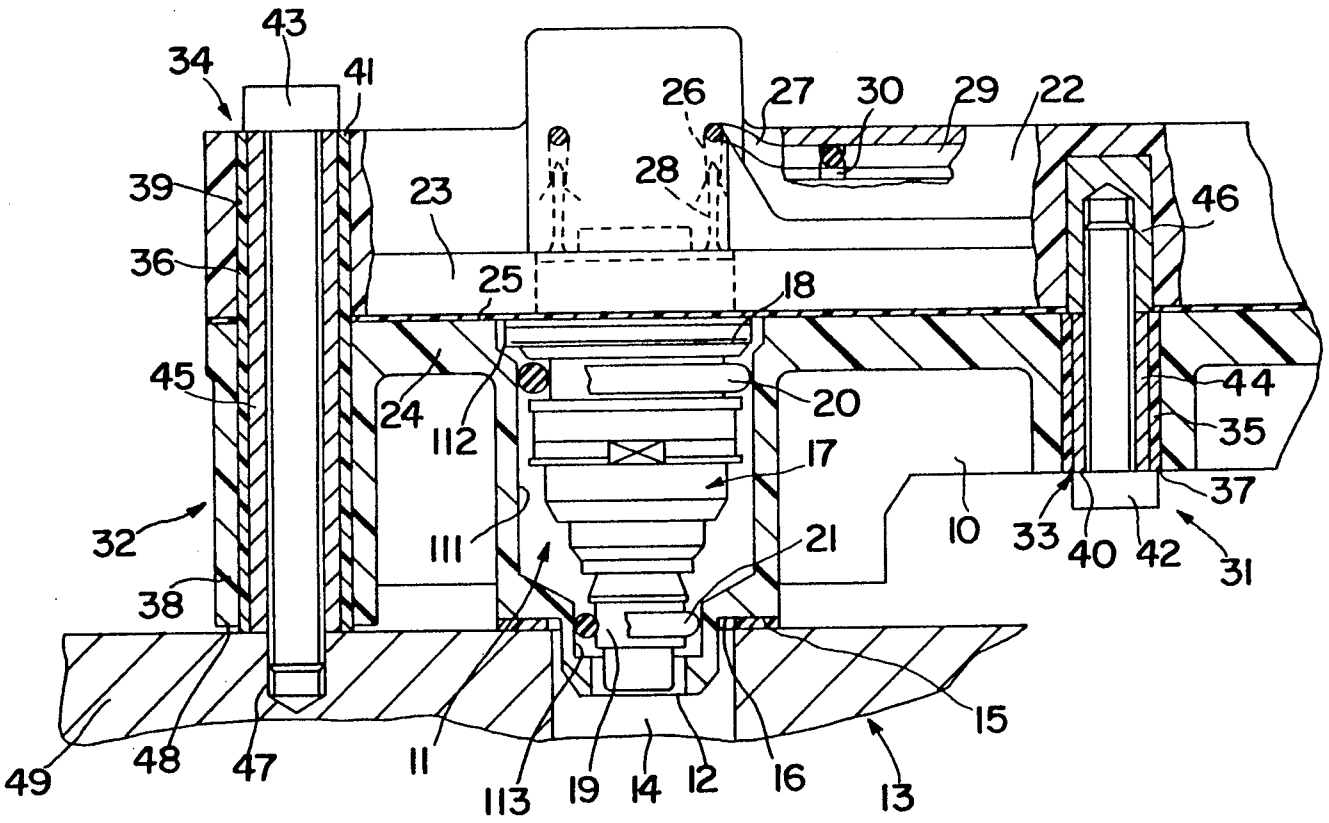
46
44
35
37
31
42
40
33
22
29
30
27
26
28
18
20
17
21
10
15
13
16
12
14
19
113
11
111
112
25
23
24
41
43
34
39
36
45
32
38
47
48
49

FUEL DISTRIBUTOR FOR FUEL INJECTION SYSTEMS OF INTERNAL COMBUSTION ENGINES

PRIOR ART

The invention is directed to a fuel distributor for fuel injection systems of internal combustion engines defined hereinafter.

Such a fuel distributor is known from DE 37 30 571 A1 or from DE 32 28 508 A1. In both fuel distributors, fixing to the internal combustion engine is effected via webs or flanges arranged on the distributor housing which have through holes through each of which a bolt is passed and screwed up on the internal combustion engine.

In such fuel distributors, the working noises of the fuel injection valves and the pressure pulsations which are caused by the clocking of the fuel injection valves are transmitted to the adjoining components, such as the intake manifold of the internal combustion engine, and lead to unpleasant noise generation in the engine compartment of the motor vehicle.

For noise reduction in a known, so-called top-feed fuel injection valve (DE 28 27 850 A1), which is inserted directly into a connecting branch on the intake manifold and is grasped by a holder firmly clamped to the intake manifold, a resilient ring is provided which is placed with nonpositive engagement around the fuel injection valve and on which the holder engages.

ADVANTAGES OF THE INVENTION

The fuel distributor according to the invention has the advantage that, even in the design with a distributor housing which accommodates fuel-flooded location holes, in a number of fuel injection valves corresponding to the number of cylinders of the internal combustion engine, it is largely acoustically decoupled from the adjoining components. Extensive reduction of noise in the engine compartment of the vehicle is thereby achieved, even when a fuel distributor of the type described at the outset is used.

Advantageous further developments and improvements of the fuel distributor indicated are possible by virtue of the measures presented herein.

In an advantageous embodiment of the invention each rubber-metal element is realized by a resilient sleeve, e.g. made of elastomer, and a clamping element which can be anchored on the intake manifold. The resilient sleeve is inserted into mutually aligned through holes in the distributor housing and hold-down clamping elements that pass through the sleeve, pressing the sleeve radially against the hole walls, and overlaps the sleeve with a clamping shoulder, the diameter of which is not larger than the outside diameter of the sleeve.

According to a further embodiment of the invention, the clamping element comprises a clamping bolt and a metallic distance sleeve surrounding the bolt barrel. At its end faces, the distance sleeve rests against the bolt head and against the fixing flange of the intake manifold, enabling the fuel distributor to be fixed to the fixing flange of the intake manifold with a defined tightening torque. The of the bolt head is slightly smaller than the of the resilient sleeve surrounding the distance sleeve, the rubber-metal character thus being retained.

If the hold-down simultaneously forms the multiple connector for the electrical contacting of the electromagnetically actuated fuel injection valves, then, according to a further embodiment of the invention, the connecting cables leading to the socket contacts in the multiple connector are fixed in the cable ducts provided in the hold-down, e.g. by mechanical fixing elements or by compound-filling or filling with foamed material. Free conductor cross-sections capable of vibration are thereby avoided and, here too, noise generation is prevented.

Distributor housing and hold-down expediently consist of plastic but can also be manufactured from metal.

DRAWING

The invention is explained in greater detail in the description which follows with reference to an illustrative embodiment represented in the drawing. The drawing shows a partial cross-section of a fuel distributor for a fuel injection system of an internal combustion engine.

DESCRIPTION OF THE ILLUSTRATIVE EMBODIMENT

The fuel distributor represented in cross-section in the drawing has a distributor housing 10 formed of plastic, which contains a plurality of location holes 11 for receipt of fuel injection valves. The number of location holes 11 corresponds to the number of cylinders of the internal combustion engine, so that in the case of a fuel distributor for a four-cylinder internal combustion engine four location holes 11 are provided in the distributor housing 10. Each longitudinally through and stepped location hole 11 has a longer hole section 111 and a hole section 112 and 113 in each case arranged before and after hole section 111, hole section 112 having a larger hole diameter and hole section 113 having a smaller hole diameter than the central hole section 111. Hole section 113 ends with an outlet opening 12 and, after installation, protrudes into an injection opening 14 formed in an intake manifold 13 of an internal combustion engine. Provided on the intake manifold 13 in the region of the injection opening 14 is a fixing flange 49, on which there rests with the interposition of a resilient sealing ring 15 made of elastomer a bearing surface 16 arranged on the distributor housing 10 coaxially to the location hole 11 and in a manner set back from the outlet opening 12 of the location hole 11. An electromagnetically actuable fuel injection valve 17 of known construction is inserted into each location hole 11. Such a fuel injection valve is represented in detail in, for example DE 37 05 848 A1 now U.S. Pat. No. 4,817,575. The fuel injection valve 17 rests by a housing flange 18 in hole section 112 and by an outlet nozzle 19 in hole section 113 respectively. Hole section 111, which is connected to a fuel supply line not visible here, is sealed off fluid tightly by two O-rings 20, 21, which are supported radially in hole section 111 and 113 respectively, on the one hand against the fuel injection valve 17 and on the other hand against the wall of the hole. A complete distributor housing 10 with inserted fuel injection valves 17, in which the course of the fuel supply line can also be seen, is presented in DE 37 30 571 A1.

To fix the fuel injection valves 17 in the location holes 11 of the distributor housing 10 a hold-down 22 made of plastic is used, which rests by a clamping flange 23 on a support flange 24 on the distributor housing 10 and overlaps the housing flange 18 of the fuel injection valve 17. By means of this overlap region of the clamping flange 23, the hold-down 22 holds the fuel injection valves 17 firmly in the distributor housing 10. To avoid noise transmissions, a continuous flat gasket 25 made of elastomer is placed between the clamping flange 23 of the hold-down 22 and the support flange 24 of the distributor housing 10.

The hold-down 22 is simultaneously designed as a so-called multiple connector, which contains socket contacts 26 and connecting cables 27 leading to the socket contacts. The socket contacts 26 are arranged in such a way that when the hold-down 22 is placed on the distributor housing 10 they are pushed over pins 28 on the fuel injection valves 17. Via the connecting cables 27, socket contacts 26 and pins 28, the power supply of the electromagnets of the fuel injection valves 17 is established. The connecting cables 27 are laid in cable ducts 29 within the hold-down 22. To avoid the generation of noise, the connecting cables 27 are fixed in the cable ducts 29, in the illustrative embodiment by a mechanical cable support 30. However, the cable ducts 29 can also be compound-filled or filled with foamed material in order to fix the connecting cables 27.

Both the connection between hold-down 22 and distributor housing 10 and the fixing of the complete fuel distributor to the fixing flange 49 of the intake manifold 13 are effected by means of so-called rubber-metal elements 31 and 32 respectively. Each rubber-metal element 31 and 32 is composed of a clamping element 33 and 34 respectively and a resilient sleeve 35 and 36 respectively, made of elastomer, surrounding the latter. Resilient sleeve 35 is inserted into a through hole 37 in the distributor housing 10 while resilient sleeve 36 is introduced into two mutually aligned through holes 38 and 39 in the distributor housing 10 and in the hold-down 22. Clamping element 31 passes through resilient sleeve 35 with radial pressure against the hole wall of the through hole 37 and is anchored in the hold-down 22. Clamping element 34 passes through resilient sleeve 36 in the same way with radial pressure against the hole walls of the through holes 38 and 39 and is anchored in the fixing flange 49 on the intake manifold 13. In both cases, the clamping element 33 and 34, respectively, overlaps the associated resilient sleeve 35 and 36 respectively at their end face turned away from their anchorage, with a clamping shoulder 40 and 41 respectively which is not larger than the outside diameter of the resilient sleeve 35 and 36 respectively.

Each clamping element 33, 34 is formed by a clamping bolt 42, 43 and a metallic distance sleeve 44 and 45, respectively, surrounding the bolt barrel. The undersides of the bolt heads each form the clamping shoulders 40 and 41 respectively. Inserted into the hold-down 22 are corresponding threaded bushes 46, into which in each case one of the clamping bolts 42 is screwed with a defined tightening torque. At the underside of the distributor housing 10, said underside facing towards the fixing flange 49 of the intake manifold 13, distance sleeve 45 protrudes slightly beyond said distributor housing, with the result that when the fuel distributor is clamped to the intake manifold 13, a small gap 48 remains between the distributor housing 10 and the fixing flange 49 of the intake manifold 13. Resilient sleeve 36 can likewise protrude to the same extent beyond the distributor housing 10, although this is not compulsory. The bolt barrel of the clamping bolt 43 is screwed into a threaded hole 47 in the fixing flange 49, likewise with a defined tightening torque. In the case where the distributor housing 10 and hold-down 22 are made of plastic, the two distance sleeves 44, 45 permit the application of a precisely defined tightening torque of the clamping bolts 42, 43. The distributor housing 10 and the hold-down 22 can also be made of metal, with the construction of the fuel distributor otherwise being identical.

The foregoing relates to preferred exemplary embodiments of the invention, it being understood that other variants and embodiments thereof are possible within the spirit and scope of the invention, the latter being defined by the appended claims.

We claim:

1. A fuel distributor for fuel injection systems of internal combustion engines including an intake manifold, said fuel distributor having a distributor housing (10) which has a plurality of location holes (11), connected to one another by a fuel supply line, for accommodating electromagnetically actuated fuel injection valves (17), a hold-down (22) clamped firmly on the distributor housing (10), for the purpose of fixing the fuel injection valves (17) in the location holes (11), which hold-down rests by a clamping flange (23) on a support flange (24) on the distributor housing (10) at least in the vicinity of each location hole (11), a gasket (25) is arranged between the clamping flange (23) and the support flange (24), a fixing means attachment (32) for fixing the fuel distributor at the intake manifold (13) of the internal combustion engine, said gasket being interposed between the clamping flange (23) and the support flange (24) and being designed as a noise-decoupling flat gasket (25) made of elastomer, said fixing means attachment (32) includes a resilient sleeve (36) made of elastomer, said resilient sleeve is inserted into mutually aligned through holes (38, 39) in the distributor housing (10) and through said hold-down (22), and a clamping element (34) which is anchored in a fixing flange (49) on the intake manifold (13), said clamping element includes a portion that passes through the resilient sleeve (36) with radial pressure against walls of the through holes and overlaps the resilient sleeve at the end face turned away from the intake manifold (13) with a clamping shoulder (41) which is not larger than the outside diameter of the sleeve (36).

2. A fuel distributor according to claim 1, in which the clamping element (34) is formed by a clamping bolt (43) having a bolt head, the bolt head diameter of which is slightly smaller than the outside diameter of the resilient sleeve (36) and the bolt barrel of which is screwed into a threaded hole (47) in the fixing flange (49) on the intake manifold (13) with a defined tightening torque, the clamping element further includes a rigid, preferably metallic distance sleeve (45) which surrounds the bolt barrel and on which the bolt head is supported.

3. A fuel distributor according to claim 2, in which at the hole end turned towards the fixing flange (49) on the intake manifold (13), the distance sleeve (45) protrudes out of the through hole (3) by a small end section.

4. A fuel distributor according to claim 1, in which the hold-down (22) and the distributor housing (10) are connected to each other by a second fixing means attachment (31).

5. A fuel distributor according to claim 2, in which the hold-down (22) and the distributor housing (10) are connected to each other by a second fixing means attachment (31).

6. A fuel distributor according to claim 3, in which the hold-down (22) and the distributor housing (10) are connected to each other by a second fixing means attachment (31).

7. A fuel distributor according to claim 4, in which said second fixing means attachment (31) has a second resilient sleeve (35) made of elastomer, which is inserted into a through hole (37) in the distributor housing (10), and a clamping element (33) which is anchored in the hold-down (22), passes through the second resilient sleeve (35) with radial pressure against the hole wall and overlaps the second resilient sleeve at the end face turned away from the hold-down (22) with a clamping shoulder (40) which is not larger than the outside diameter of the second resilient sleeve (35).

8. A fuel distributor according to claim 5, in which said second fixing means attachment (31) has a second resilient sleeve (35) made of elastomer, which is inserted into a through hole (37) in the distributor housing (10), and a clamping element (33) which is anchored in the hold-down (22), passes through the second resilient sleeve (35) with radial pressure against the hole wall and overlaps the second resilient sleeve at the end face turned away from the hold-down (22) with a clamping shoulder (40) which is not larger than the outside diameter of the second resilient sleeve (35).

9. A fuel distributor according to claim 6, in which said second fixing means attachment (31) has a second resilient sleeve (35) made of elastomer, which is inserted into a through hole (37) in the distributor housing (10), and a clamping element (33) which is anchored in the hold-down (22), passes through the second resilient sleeve (35) with radial pressure against the hole wall and overlaps the second resilient sleeve at the end face turned away from the hold-down (22) with a clamping shoulder (40) which is not larger than the outside diameter of the second resilient sleeve (35).

10. A fuel distributor according to claim 7, in which the clamping element (33) is formed by a clamping bolt (42) having a bolt head, the bolt head diameter of which is slightly smaller than the outside diameter of the sleeve (35) and the bolt barrel of which is screwed into a threaded bush (46) inserted into the hold-down (22), and by a rigid, preferably metallic distance sleeve (44) which surrounds the bolt barrel and on which the bolt head is supported.

11. A fuel distributor according to claim 8, in which the clamping element (33) is formed by a clamping bolt (42) having a bolt head, the bolt head diameter of which is slightly smaller than the outside diameter of the sleeve (35) and the bolt barrel of which is screwed into a threaded bush (46) inserted into the hold-down (22), and by a rigid, preferably metallic distance sleeve (44) which surrounds the bolt barrel and on which the bolt head is supported.

12. A fuel distributor according to claim 9, in which the clamping element (33) is formed by a clamping bolt (42) having a bolt head, the bolt head diameter of which is slightly smaller than the outside diameter of the sleeve (35) and the bolt barrel of which is screwed into a threaded bush (46) inserted into the hold-down (22), and by a rigid, preferably metallic distance sleeve (44) which surrounds the bolt barrel and on which the bolt head is supported.

13. A fuel distributor according to claim 1, in which at least in the region of the location holes (11), the distributor housing (10) rests by a bearing surface (16) against the fixing flange (49) of the intake manifold (13) and in that a resilient sealing ring (15) made of elastomer, is placed between bearing surface (16) and the fixing flange (49).

14. A fuel distributor according to claim 2, in which at least in the region of the location holes (11), the distributor housing (10) rests by a bearing surface (16) against the fixing flange (49) of the intake manifold (13) and in that a resilient sealing ring (15) made of elastomer, is placed between bearing surface (16) and the fixing flange (49).

15. A fuel distributor according to claim 3, in which at least in the region of the location holes (11), the distributor housing (10) rests by a bearing surface (16) against the fixing flange (49) of the intake manifold (13) and in that a resilient sealing ring (15) made of elastomer, is placed between bearing surface (16) and the fixing flange (49).

16. A fuel distributor according to claim 1, in which the hold-down (22) is simultaneously designed as a multiple connector for an electrical contact of the fuel injection valves (17) and has plug-in contacts (26) and connecting cables (27) which lead to the plug-in contacts (26) and are guided in cable ducts (29), and the connecting cables (27) are fixed in the cable ducts (29) by mechanical fixing elements (30) or by compound-filling or filling with foamed material.

17. A fuel distributor according to claim 2, in which the hold-down (22) is simultaneously designed as a multiple connector for an electrical contact of the fuel injection valves (17) and has plug-in contacts (26) and connecting cables (27) which lead to the plug-in contacts (26) and are guided in cable ducts (29), and the connecting cables (27) are fixed in the cable ducts (29) by mechanical fixing elements (30) or by compound-filling or filling with foamed material.

18. A fuel distributor according to claim 3, in which the hold-down (22) is simultaneously designed as a multiple connector for an electrical contact of the fuel injection valves (17) and has plug-in contacts (26) and connecting cables (27) which lead to the plug-in contacts (26) and are guided in cable ducts (29), and the connecting cables (27) are fixed in the cable ducts (29) by mechanical fixing elements (30) or by compound-filling or filling with foamed material.

19. A fuel distributor according to claim 1, in which the hold-down (22) is simultaneously designed as a multiple connector for the electrical contacting of the fuel injection valves (17) and has plug-in contacts (26) and are guided in cable ducts (29), and the connecting cables (27) are fixed in the cable ducts (29) by mechanical fixing elements (30) or by compound-filling or filling with foamed material.

20. A fuel distributor according to claim 2, in which the hold-down (22) is simultaneously designed as a multiple connector for the electrical contacting of the fuel injection valves (17) and has plug-in contacts (26) and are guided in cable ducts (29), and the connecting cables (27) are fixed in the cable ducts (29) by mechanical fixing elements (30) or by compound-filling or filling with foamed material.

21. A fuel distributor according to claim 3, in which the hold-down (22) is simultaneously designed as a multiple connector for the electrical contacting of the fuel injection valves (17) and has plug-in contacts (26) and are guided in cable ducts (29), and the connecting cables (27) are fixed in the cable ducts (29) by mechanical fixing elements (30) or by compound-filling or filling with foamed material.

* * * * *